US008074900B2

(12) United States Patent
Brown

(10) Patent No.: US 8,074,900 B2
(45) Date of Patent: Dec. 13, 2011

(54) FUEL OIL ATOMIZER

(75) Inventor: Dave Brown, Coquitlam (CA)

(73) Assignee: Turbulent Diffusion Technology Inc. (CA)

( * ) Notice: Subject to any disclaimer, the term of this patent is extended or adjusted under 35 U.S.C. 154(b) by 663 days.

(21) Appl. No.: 12/169,546

(22) Filed: Jul. 8, 2008

(65) Prior Publication Data

US 2008/0265062 A1 Oct. 30, 2008

Related U.S. Application Data

(62) Division of application No. 11/214,792, filed on Aug. 31, 2005, now abandoned.

(51) Int. Cl.
*B05B 7/06* (2006.01)

(52) U.S. Cl. ..... 239/429; 239/433

(58) Field of Classification Search ..... 239/88, 239/406, 416.5, 417.5, 426, 429, 433, 434; 431/8, 11, 211, 239

See application file for complete search history.

(56) References Cited

U.S. PATENT DOCUMENTS

| | | | |
|---|---|---|---|
| 2,414,459 | A | 1/1947 | Fletcher |
| 3,650,476 | A | 3/1972 | Rackley et al. |
| 4,614,490 | A | 9/1986 | Kiczek et al. |
| 4,699,587 | A | 10/1987 | Shimoda et al. |
| 4,890,793 | A | 1/1990 | Fuglistaller et al. |

*Primary Examiner* — Davis Hwu

(74) *Attorney, Agent, or Firm* — Cameron IP

(57) ABSTRACT

There is provided a fuel oil atomizer comprised of an elongated outer member, an elongated inner member and an atomizing head. The inner member is a fuel supply conduit which is coaxially received within the central opening of the outer member defining therebetween a generally annular atomizing fluid supply conduit. The atomizing head includes a fuel chamber, an atomizing fluid chamber and a mixing chamber. The fuel supply conduit communicates with the fuel chamber. The atomizing fluid supply conduit communicates with the atomizing fluid chamber. The fuel chamber has a first end and a second end. The atomizing fluid chamber is circumambient to the first end of the fuel chamber and the fuel chamber has a portion that extends axially from the atomizing fluid chamber. The mixing chamber is circumambient to the second end of the fuel chamber.

9 Claims, 3 Drawing Sheets

FUEL OIL ATOMIZER

CROSS REFERENCE TO RELATED APPLICATION

This application is a divisional of U.S. patent application Ser. No. 11/214,792 filed on the Aug. 31, 2005 now abandoned, complete disclosure of which is incorporated herein by reference.

BACKGROUND OF THE INVENTION

The present invention relates to fuel oil burners and, in particular, to fuel oil atomizers.

To efficiently burn fuel oil it is necessary to atomize the fuel oil into a fine mist. As such, there have been many improvements made to the efficiency of fuel oil atomizers. However, economic problems related to manufacturing costs and operational costs associated with fuel oil atomizers still persist.

SUMMARY OF THE INVENTION

The present invention provides an economically manufactured fuel oil atomizer which efficiently and effectively atomizes fuel oil. The present invention further provides a fuel oil atomizer that can be easily and economically maintained.

According to one aspect of the invention there is provided a fuel oil atomizer comprised of an elongated outer member, an elongated inner member, and an atomizing head. The elongated outer member has a first end, a second end, and a central opening. The first end of the outer member has a means for communicating with an atomizing fluid supply. The elongated inner member has a first end, a second end, and a central opening. The first end of the inner member has a means for communicating with a fuel supply and the central opening of the inner member is a fuel supply conduit. The inner member is coaxially received within the central opening of the outer member defining therebetween a generally annular atomizing fluid supply conduit.

The atomizing head includes a fuel chamber, an atomizing fluid chamber, and a mixing chamber. The fuel supply conduit communicates with the fuel chamber. The atomizing fluid supply conduit communicates with the atomizing fluid chamber. The fuel chamber has a first end and a second end. The atomizing fluid chamber is circumambient to the first end of the fuel chamber and the fuel chamber has a portion that extends axially from the atomizing fluid chamber. The mixing chamber is circumambient to the second end of the fuel chamber.

According to another aspect of the invention there is provided a fuel oil atomizer comprised of an elongated outer member, an elongated inner member and an atomizing head. The elongated outer member has a first end, a second end, and a central opening. The first end of the outer member has a means for communicating with an atomizing fluid supply. The elongated inner member has a first end, a second end, and a central opening. The first end of the inner member has a means for communicating with a fuel supply and the central opening of the inner member is a fuel supply conduit. The inner member is coaxially received within the central opening of the outer member defining therebetween a generally annular atomizing fluid supply conduit.

The atomizing head includes an inner nozzle and an outer nozzle. The inner nozzle has an atomizing fluid chamber and a fuel chamber. The atomized fluid supply conduit communicates with the atomizing fluid chamber. The fuel supply conduit communicates with the fuel chamber. The atomizing fluid chamber is circumambient to the fuel chamber and the fuel chamber has a portion which extends axially from the atomizing fluid chamber towards a discharge end of the inner nozzle. The outer nozzle has an open first end and a second end. The discharge end of the inner nozzle is received by the outer nozzle at the first end of the outer nozzle. A mixing chamber is defined in the space between the discharge end of the inner nozzle and the second end of the outer nozzle. An atomized fuel discharge conduit extends from the mixing chamber through the outer nozzle.

BRIEF DESCRIPTION OF THE DRAWING

Referring to the drawings.

DETAILED DESCRIPTION OF THE PREFERRED EMBODIMENT

Figure 1:
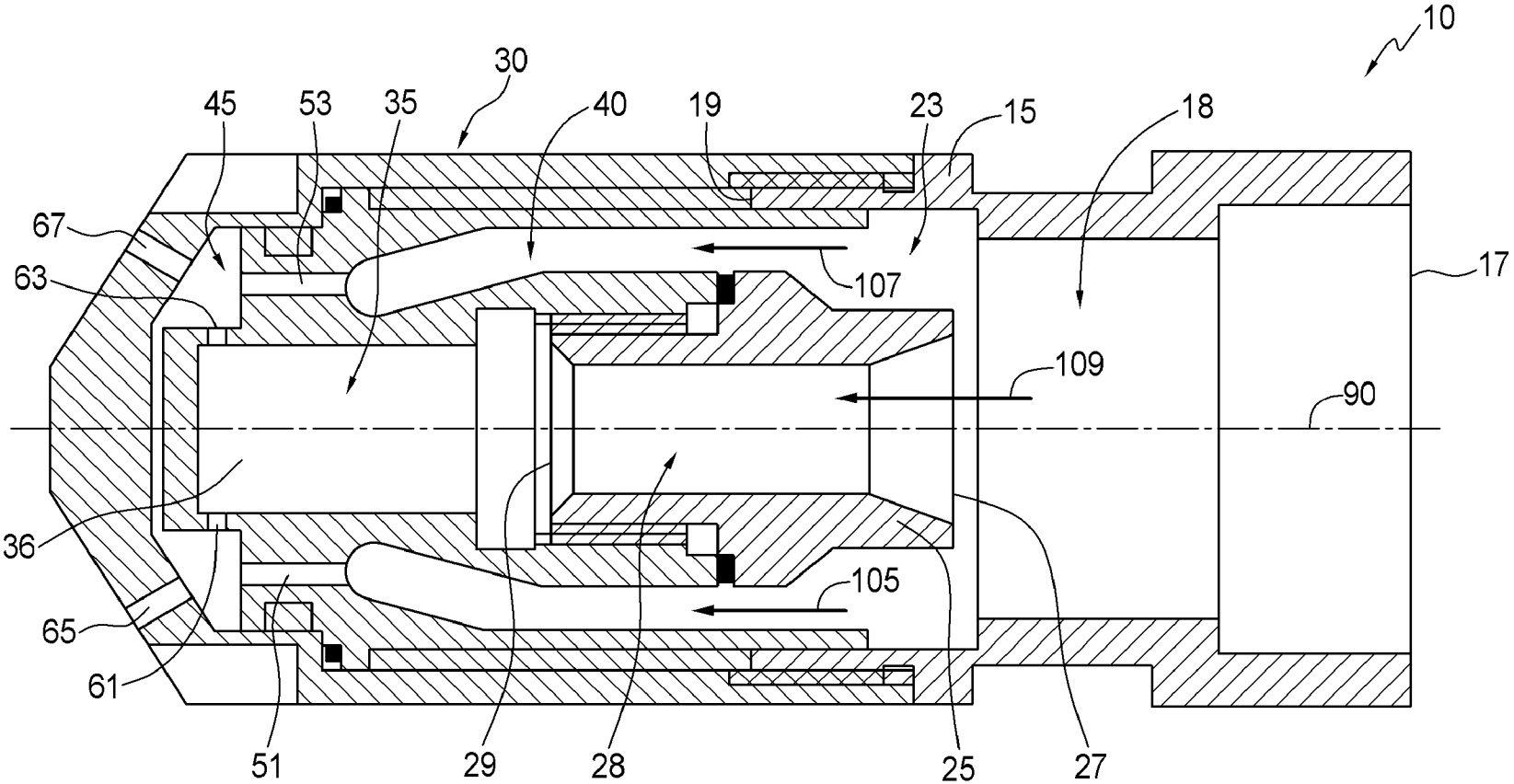
FIG. 1 is a diametrical, cross-sectional view of a fuel oil atomizer according to an embodiment of the invention.

Referring to the drawings and first to FIG. 1 there is shown a fuel oil atomizer 10 according to an embodiment of the invention. The atomizer 10 includes an elongated outer member 15, an elongated inner member 25, and an atomizing head 30, all of which are circular in section in this embodiment of the invention. The outer member 15 has a first end 17, a second end 19, and a central opening 18 extending therebetween. The first end 17 of the outer member has a means for connecting to an atomizing fluid supply (not shown). The inner member 25 has a first end 27, a second end 29, and a central opening 28 extending therebetween. The first end of the 27 of the inner member has a means for connecting to a fuel supply (not shown). The outer member 15 and the inner member 25 communicate with the atomizing head 30.

Figure 3:
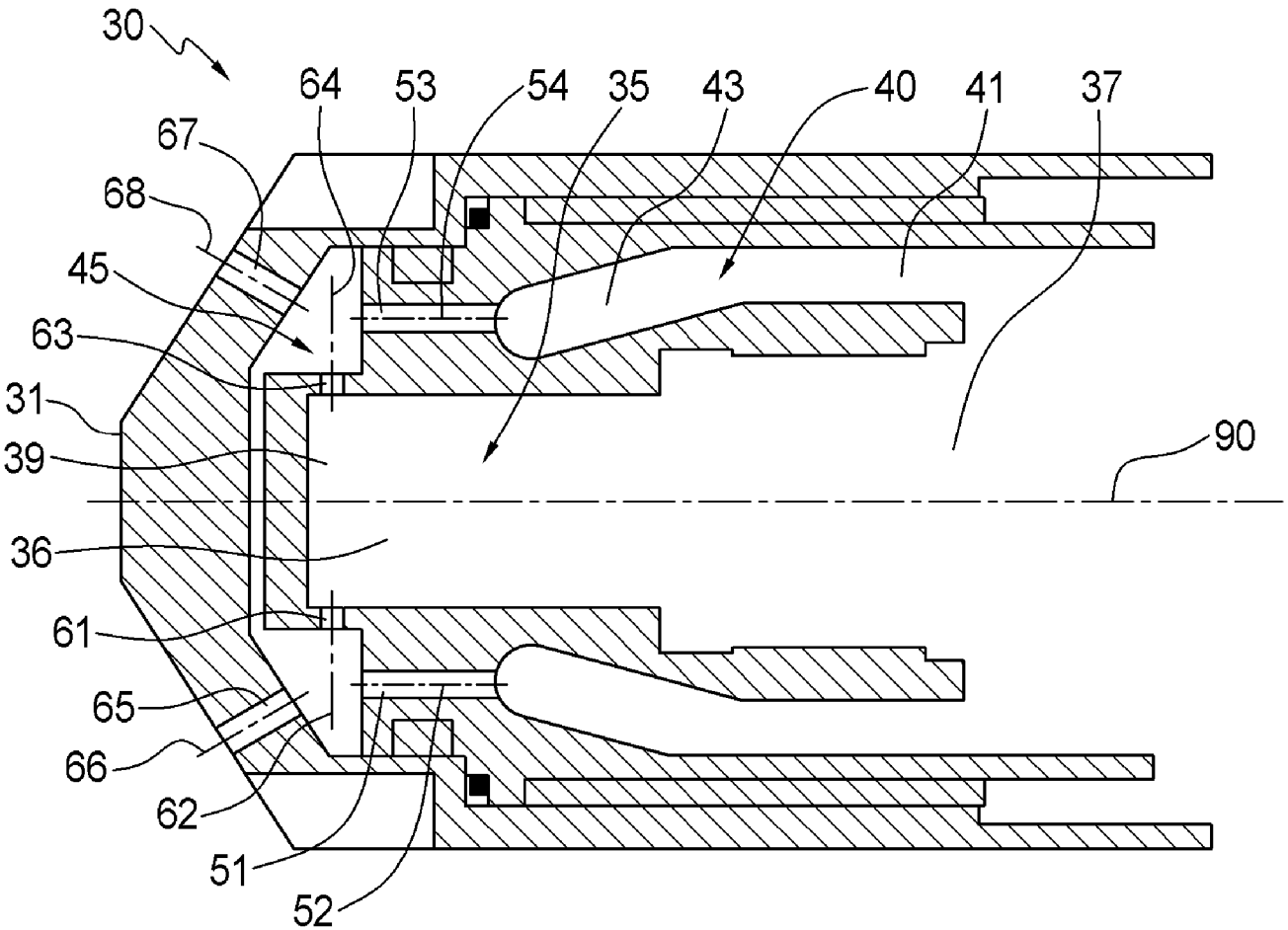
FIG. 3 is an elevational, cross-sectional view of the atomizing head of the fuel oil atomizer of FIG. 1.

As best shown in FIG. 3, the atomizing head 30 includes a fuel chamber 35, an atomizing fluid chamber 40, and a mixing chamber 45. The fuel chamber 35 is elongated and has a first end 37 and a second end 39. The atomizing fluid chamber 40 is located in the vicinity of the first end 37 of the fuel chamber 35 and is generally annular and circumambient to the fuel chamber 35. The atomizing fluid chamber 40 has an annular cylindrical portion 41 and an annular frustoconical portion 43. A portion 36 of the fuel chamber 35 extends axially, with respect to the frustoconical portion 43 of the atomizing fluid chamber 40, towards a discharge end 31 of the atomizing head 30. The mixing chamber 45 is located in the vicinity of the second end 39 of the fuel chamber and is generally frustoconical and circumambient to the fuel chamber 35.

A plurality of atomizing fluid discharge conduits 51 and 53 extend from the atomizing fluid chamber 40 to the mixing chamber 45 allowing the frustoconical portion 43 of the atomizing fluid chamber 40 to communicate with the mixing chamber 45. Only two atomizing fluid discharge conduits 51 and 53 are shown in FIG. 3, but there are a plurality of atomizing fluid discharge conduits. The atomizing fluid discharge conduits 51 and 53 have longitudinal axes, 52 and 54 respectively, which are generally parallel to a longitudinal axis 90 of the atomizing head 30.

Figure 2:
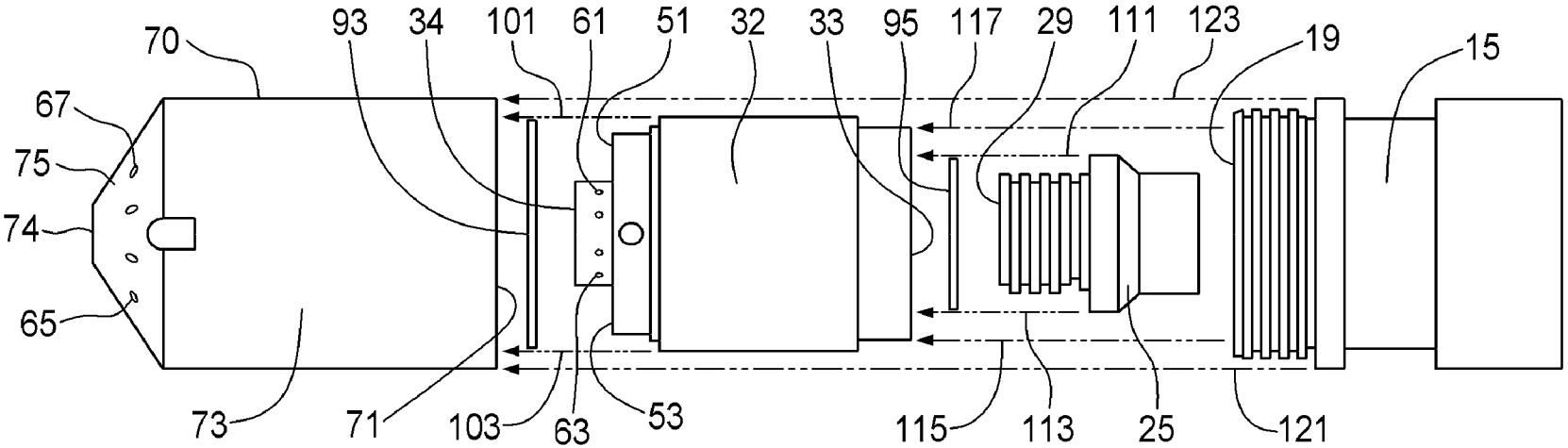
FIG. 2 is a diametrical, exploded view of the fuel oil atomizer of FIG. 1.

A plurality of fuel discharge apertures 61 and 63 extend from the fuel chamber 35 to the mixing chamber 45 allowing the fuel chamber 35 to communicate with the mixing chamber 45. Only two fuel discharge apertures 61 and 63 are shown in FIG. 3, but there are a plurality of fluid discharge apertures as shown in FIG. 2. The fuel discharge apertures 61 and 63 have longitudinal axes, 62 and 64 respectively, which are generally perpendicular to a longitudinal axis 90 of the atomizing head 30.

A plurality of atomized fuel discharge conduits 65 and 67 extend from the mixing chamber 45 through the atomizing head 30 allowing atomized fuel to be discharged from the atomizer 10. Only two atomized fluid discharge conduits 65 and 67 are shown in FIG. 3, but there are a plurality of atomized fluid discharge conduits as shown in FIG. 2. The atomized fuel discharge conduits 65 and 67, have axes 66 and 68 respectively, wherein angles between the longitudinal axis 90 of the atomizing head 30 and the longitudinal axes 66 and 68 of the atomized fuel discharge conduits 61 and 63 range from 15° to 75°. As best shown in FIGS. 1 and 3, the atomized fluid discharge conduits are 65 and 67 face the fuel discharge apertures 61 and 63 with no intermediate structure therebetween. In other words, the fuel discharge conduits 65 and 67 are in a line of sight of the fuel discharge conduits 61 and 63 across the mixing chamber 45.

In the embodiment of the invention shown in the Figures, the fuel chamber 35 and the atomizing fluid chamber 40 are integral and define an inner nozzle 32 which is best shown in FIG. 2. The inner nozzle 32 has a first open end 33 and a second discharge end 34. Fuel is discharged from the fuel chamber 35, shown in FIG. 3, through the fuel discharge apertures 61 and 63 at the discharge end 34. Atomizing fluid is discharged from the atomizing fluid chamber 40, shown in FIG. 3, through the atomizing fluid discharge conduits 51 and 53 at the discharge end 34.

There is an outer nozzle 70, shown in FIG. 2, which has an open first end 71 and second end 74. The outer nozzle has a generally cylindrical portion 73 adjacent the first end, and a generally frustoconical portion 75 adjacent the second end 74. The inner nozzle 32 is received within the outer nozzle 70 as indicated by arrows 101 and 103 such that the discharge end 34 of the inner nozzle 32 extends into the frustoconical portion 75 of the outer nozzle 70. There is an oil seal ring 93 between the inner nozzle 32 and outer nozzle 70. The mixing chamber 45 is defined in the frustoconical cavity between the discharge end 34 of the inner nozzle 32 and the second end 74 of the outer nozzle. The atomized fuel discharge conduits 65 and 67 are located on the frustoconical portion 75 of the outer nozzle.

Referring back to FIG. 1, the inner member 25 is coaxially received within the central opening 18 of the outer member 15, defining therebetween a generally annular atomizing fluid supply conduit 23 which supplies atomizing fluid to the atomizing head 30. The atomizing fluid supply conduit 23 communicates with the atomizing fluid chamber as indicated by arrows 105 and 107. The central opening 28 of the inner member 25 acts as a a fuel supply conduit and communicates with the fuel chamber 35 as indicated by arrow 109.

As best shown in FIG. 2, in the embodiment of the invention shown in the Figures, the atomizer is constructed as follows. The second end 29 of the inner member 25 is threadedly received by the inner nozzle 32, as indicated by arrows 111 and 113, thereby allowing the central opening 28 of the inner member 25, or the fuel supply conduit, to communicate with fuel chamber 35, as shown in FIG. 1. There is an oil seal ring 95 between the inner member 25 and the inner nozzle 32. The first end 33 of the inner nozzle is received by the outer member 15 as indicated by arrows 115 and 117, thereby allowing the atomizing fluid supply conduit 23 to communicate with atomizing fluid chamber 40, as shown in FIG. 1. The second end 19 of the outer member 15 is threadedly received by the outer nozzle as indicated by arrows 121 and 123, thereby maintaining the individual components, namely the outer member 15, the inner member 25, the inner nozzle 32 and the outer nozzle 70, together as a singular unit. Construction of the atomizer 10 in the above described manner allows for rapid assembly and disassembly of the atomizer for maintenance and cleaning purposes.

In operation the fuel oil atomizer 10 functions as follows:—

The inner member 25 is connected to a fuel supply (not shown) and the outer member 15 is connected to an atomizing fluid supply (not shown). In a preferred embodiment of the invention to the fuel is fuel oil and the atomizing fluid is steam. Fuel flows from the fuel supply along the fuel supply conduit 28 to the fuel chamber 35. From the fuel chamber 35, the fuel is discharged into the mixing chamber 45 through the fuel discharge apertures 61 and 63. Atomizing fluid flows from atomizing fluid supply along the atomizing fluid supply conduit 23 to the atomizing fluid chamber 40. The length of the atomizing fluid chamber 40, approximately 2 inches in a preferred embodiment of the invention, ensures laminar flow of the atomizing fluid when it is discharged from the atomizing fluid chamber 40 through atomizing fluid discharge conduits 51 and 53 and into the mixing chamber 45.

Atomization occurs in a three step process over a distance of approximately ¼ inch of linear travel in the proximity of the atomized fuel discharge conduits 65 and 67. The first step occurs in the mixing chamber 45 when the flow of fuel discharged from the fuel chamber 35 is sheared by a high pressure laminar flow of atomization fluid discharged from the atomizing chamber 40. The second step occurs when the high pressure atomization fluid expands in the mixing chamber 45 causing further breakup of the fuel. The third step occurs when the emulsion of fuel and atomizing fluid is discharged through the atomized fuel discharge conduits where further expansion of the emulsion results in a generally homogeneous mixture of finely atomized fuel and atomizing fluid. In a preferred embodiment of the invention, combustion occurs between 3 to 6 inches from the atomizing head 30.

It will be understood by someone skilled in the art that many of the details provided above are by way of example only and are not intended to limit the scope of the invention which is to be determined with reference to the following claims.

What is claimed is:

1. A fuel oil atomizer, comprising:

an elongated outer member having a first end, a second end, and a central opening, the first end of the outer member having a means for communicating with an atomizing fluid supply;

an elongated inner member having a first end, a second end, and central opening, the first end of the inner member having a means for communicating with a fuel supply and the central opening of the inner member being a fuel supply conduit, the inner member being coaxially received within the central opening of the outer member defining therebetween a generally annular atomizing fluid supply conduit; and an atomizing head, the fuel supply conduit and atomizing fluid supply conduit communicating with the atomizing head, the atomizing head including:

an inner nozzle having an atomizing fluid chamber and a fuel chamber, the atomizing fluid supply conduit communicating with the atomizing fluid chamber and the fuel supply conduit communicating with the fuel chamber, the atomizing fluid chamber being circumambient to the fuel chamber and the fuel chamber having a portion that extends axially from the atomizing fluid chamber towards a discharge end of the inner nozzle;

an outer nozzle having an open first end and a second end, the discharge end of the inner nozzle being received by the outer nozzle at the first end of the outer nozzle, a mixing chamber being defined in the space between the discharge end of the inner nozzle and the second end of the outer nozzle, an atomized fuel discharge conduit extending from the mixing chamber through the outer nozzle; and an atomizing fluid discharge conduit extending from the atomizing fluid chamber to the discharge end of the inner nozzle, the atomizing fluid discharge conduit allowing the atomizing fluid chamber to communicate with the mixing chamber.

2. The atomizer as claimed in claim 1, further including a fuel discharge aperture in the portion of the fuel chamber that extends axially from the atomizing fluid chamber, the fuel discharge aperture allowing the fuel chamber to communicate with mixing chamber.

3. The atomizer as claimed in claim 2, wherein the fuel discharge aperture has an axis generally perpendicular to a longitudinal axis of the atomizing head.

4. The atomizer as claimed in claim 1, wherein the atomizing fluid discharge conduit has an axis generally parallel to a longitudinal axis of the atomizing head.

5. The atomizer as claimed in claim 1, wherein the atomized fuel discharge conduit has an axis, an angle between the axis of the atomized fuel discharge conduit and a longitudinal axis of the atomizing head, the angle being between 15° and 75°.

6. The atomizer as claimed in claim 1, wherein the atomizing fluid chamber has a first generally cylindrical portion and a second generally frustoconical portion.

7. The atomizer as claimed in claim 1, wherein the mixing chamber is generally frustoconical.

8. The atomizer as claimed in claim 1, wherein the second end of the inner member is threadedly received by the inner nozzle.

9. The atomizer as claimed in claim 1, wherein the second end of the outer member is threadedly received by the outer nozzle.

* * * * *